US005307653A

United States Patent [19]

Davis

[11] Patent Number: 5,307,653

[45] Date of Patent: May 3, 1994

[54] SLIDEBOLT AND PADLOCK SECURITY SHIELD DEVICES

[76] Inventor: Richard W. Davis, 4412 Switch Willo, Austin, Tex. 76727

[21] Appl. No.: 924,313

[22] Filed: Aug. 3, 1992

[51] Int. Cl.[5] ..... E05B 67/38

[52] U.S. Cl. ..... 70/56; 70/129; 70/417; 292/57; 292/148

[58] Field of Search ..... 70/54–56, 70/129, 417; 292/57, 148

[56] References Cited

U.S. PATENT DOCUMENTS

| | | | |
|---|---|---|---|
| 3,953,062 | 4/1976 | Maston | 292/57 |
| 4,031,719 | 6/1977 | Klingler et al. | 292/148 X |
| 4,068,505 | 1/1978 | Volk, Jr. | 70/56 |
| 4,238,941 | 12/1980 | Halopoff | 70/56 |
| 4,350,032 | 9/1982 | Kochackis | 70/56 X |
| 4,437,692 | 3/1984 | Halopoff | 292/57 |
| 4,566,296 | 1/1986 | Kochakis | 70/56 |
| 4,655,487 | 4/1987 | Korn et al. | 70/56 X |
| 4,852,920 | 8/1989 | DeForrest, Sr. | 292/205 |
| 4,896,518 | 1/1990 | Appelgren | 70/54 |
| 4,905,486 | 3/1990 | Appelbaum | 70/54 |
| 4,932,692 | 6/1990 | Nelson | 292/148 |

*Primary Examiner*—Lloyd A. Gall
*Attorney, Agent, or Firm*—John R. Flanagan

[57] ABSTRACT

A security shield device is provided in two embodiments. One embodiment includes a front cover, a rear base and a connector member connecting the front cover to the rear base. The front cover is mounted to a slidebolt latch for movement between a covered position shielding a padlock shackle coupled to a latch portion of a slidebolt latch and an uncovered position displaced from the latch portion of the slidebolt latch. The rear base mates with the latch portion of the slidebolt latch so as to attach the rear base to the slidebolt latch when the padlock shackle is coupled to the slidebolt latch. The connector member prevents movement of the front cover relative to the slidebolt latch away from the rear base which would expose the shackle of the padlock. The other embodiment includes a front cover, a rear base connected to the front cover, and apertures defined therein aligned with openings in stationary and movable latch portions of a slidebolt latch. The aligned apertures and openings receive a padlock shackle to couple the security shield device and stationary and movable latch portions together with upper edge portions of the front cover and rear base disposed on opposite sides of the latch portions shielding the latch portions of the slidebolt latch and padlock shackle coupled thereto.

24 Claims, 3 Drawing Sheets

SLIDEBOLT AND PADLOCK SECURITY SHIELD DEVICES

BACKGROUND OF THE INVENTION

1. Field of the Invention

The present invention generally relates to protective security devices and, more particularly, is concerned with security shield devices for covering portions of slidebolts and padlocks locking the slidebolts on doors of buildings, such as mini-storage facilities.

2. Description of the Prior Art

Self-storage facilities, also widely known as mini-storage facilities, are increasingly subject to vandalism and breakins of storage compartment doors. These doors are typically either rollup or flat overhead doors which employ slidebolts of differing designs. Different padlocks are commonly used to interconnect and prevent unlatching of the slidable part of the sidebolt relative to the stationary part fixed on the door. However, most padlocks are vulnerable to being broken by burglars using conventional bolt cutting tools which can be purchased at any hardware store.

One preventive measure commonly proposed to reduce burglaries is the hiring of security personnel to patrol the facilities afterhours. However, such measure may only be cost-effective at large self-storage facilities and so is not a viable solution.

Another preventive measure proposed to reduce burglaries is the use of some type of cover for a padlock to restrict access to the portions of the padlock which are vulnerable to attack and being broken or cut. Some representative padlock security covers proposed in the prior patent art are the ones disclosed in U.S. Pat. No. 4,566,296 to Kochakis, U.S. Pat. No. 4,852,920 to DeForrest, Sr., U.S. Pat. No. 4,896,518 to Appelgren, and U.S. Pat. No. 4,905,486 to Appelbaum.

While the padlock security covers of these patents may operate satisfactorily under the limited range of conditions for which they were intended, they are not seen by the inventor herein as providing a viable solution to the breakin problems being experienced at self-storage facilities. None of these covers provides sufficient protection of both the padlock and the portion of the slidebolt next to the door jamb.

Consequently, a need still exists for a suitable shield device for covering both the padlock and portion of the slidebolt next to the door jamb.

SUMMARY OF THE INVENTION

The present invention provides a slidebolt and padlock security shield device designed to satisfy the aforementioned need. Two embodiments of the shield device of the present invention are disclosed herein. The shield device of the first embodiment is adapted to fit slidebolt latches used in latching flat overhead swing-type doors. The shield device of the second embodiment is adapted to fit slidebolt latches used in latching coil rollup-type doors.

Advantageously, both embodiments of the shield device are low in cost and require no time consuming and costly assembly before they can be used. Also, the shield devices can be installed by tenants along with their padlocks. Further, one version of the first embodiment of shield device allows the facility manager to overlock the slidebolt to prevent its movement by a delinquent tenant and also to gain access to the tenant's padlock in order to remove it in cases where the tenant has vacated or has been evicted for non-payment of rent. Also, the first embodiment of the shield device can be separate from or build into the slidebolt latch.

Accordingly, the first embodiment of the present invention is directed to a slidebolt and padlock security shield device which comprises: (a) a front cover mountable to a slidebolt latch for movement between a covered position in which the front cover overlies and shields a shackle of a padlock coupled to a latch portion of the slidebolt latch and an uncovered position in which the front cover is displaced from the latch portion of the slidebolt latch; and (b) means connected to the front cover and disposed at a rear side thereof adjacent to the padlock shackle for attaching the front cover to the slidebolt latch when the padlock shackle is coupled to the slidebolt latch so as to prevent movement of the front cover relative to the slidebolt latch from the covered to uncovered position and thereby exposure of the shackle of the padlock. The attaching means includes a rear base and means for connecting the front cover to the rear base.

In a first version of the first embodiment of the shield device, the front cover is a substantially flat plate having an arcuate upper edge portion removably mountable over a shaft portion of the slidebolt. The rear base has a plate member and a pair of end members extending transverse to the plate member. The end members have apertures defined therethrough for receiving the shackle of the padlock. The connecting means is a lock mechanism mounted on the front cover and being operable between a locked condition wherein the lock mechanism is attached to the rear base and retains the front cover at the covered position and an unlocked condition wherein the lock mechanism is detached from the rear base and permits the front cover to move to the uncovered position.

In a second version of the first embodiment of the shield device, the front cover and rear base are substantially flat face plates extending at an acute angle, preferably of less than thirty degrees, relative to one another. The front cover and rear base have arcuate upper edge portions. The arcuate upper edge portion of the front cover overlies and rigidly attaches to the arcuate upper edge portion of the rear base. The attached arcuate upper edge portions of the front cover and rear base are removably mountable over a shaft portion of the slidebolt. The rear base is a plate member having a slot defined therein for receiving the latch portion of the slidebolt latch therethrough. The connecting means is a cross member extending between and rigidly attached to the front cover and rear base.

Further, a second embodiment of the present invention is directed to a slidebolt and padlock security shield device for use with a slidebolt latch having a pair of stationary and movable latch portions with openings alignable with one another to receive a shackle of a padlock for locking the latch portions together. The shield device comprises: (a) a front cover having an upper edge portion and a main face portion; (b) a rear base having an upper edge portion and a main face portion; and (c) means for defining apertures in the front cover and rear base aligned with the openings in the stationary and movable latch portions so as to receive therethrough the shackle of the padlock to thereby couple the security shield device to the stationary and movable latch portions of the slidable latch with the upper edge portions and main face portions of the respective front cover and rear base disposed on opposite sides of the latch portions of the slidebolt latch and shielding the latch portions and padlock shackle coupled thereto.

More particularly, the upper edge portion of the front cover is disposable in an overlying relation to one of the stationary and movable latch portions. The main face portion of the rear base is rigidly connected to the main face portion of the front cover. The upper edge portion of the rear base is disposable in an underlying relation to the other of the stationary and movable latch portions of the slidebolt latch such that the upper edge portions of the front cover and rear base together define a slot open at opposite ends for receiving therethrough the stationary and movable latch portions of the slidebolt latch and thereby retaining the shield device in the shielding relation to the shackle of the padlock.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
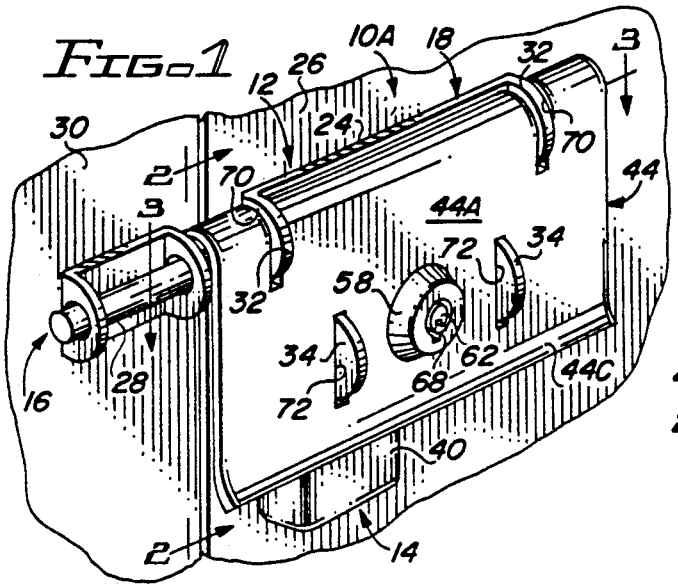
FIG. 1 a perspective view of one version of a first embodiment of a slidebolt and padlock security shield device of the present invention being mounted on one type of slidebolt latch with a padlock.
Figure 6:
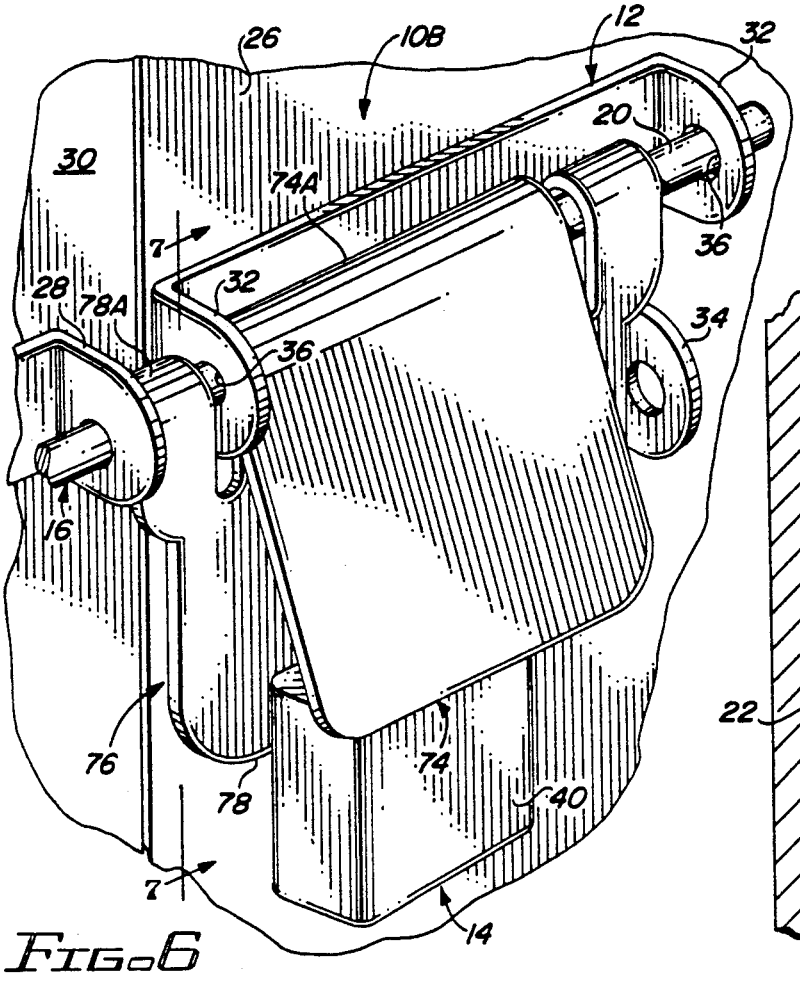
FIG. 6 is a perspective view of another version of the first embodiment of the shield device of the present invention being mounted on the one type of slidebolt latch with a padlock.

Referring to the drawings, and particularly to FIGS. 1 and 6, there is respectively illustrated first and second versions of a first embodiment of a slidebolt and padlock security shield device constructed in accordance with the principles of the present invention. The shield devices, generally designated 10A and 10B, are designed for use with one conventional type of slidebolt latch 12 and a conventional padlock 14.

As seen in FIGS. 1-3, 6 and 7, the slidebolt latch 12 includes a slidebolt 16 and an attachment plate 18 mounting the slidebolt 16 for slidable movement therealong and pivotal movement relative thereto between latched and unlatched positions. The slidebolt 16 has an elongated shaft portion 20 and a loop portion 22 integrally connected and extending transversely to the shaft portion 20. The attachment plate 18 has a flat plate 24 attached to a door 26 and positioned adjacent to a U-shaped eye member 28 attached on a jamb 30 surrounding the door 26. The attachment plate 18 also has a pair of spaced mounting ear portions 32 and a pair of spaced eye portions 34 integrally connected with and projecting outwardly from the flat plate 24. The mounting ear portions 32 have aligned apertures 36 for slidably and pivotally mounting the opposite ends of the slidebolt 16. One of the pair of eye portions 34 is projectable outwardly through the loop portion 22 of the slidebolt 16, when slidebolt 16 is at the latched position, such that the loop portion 22 straddles the one eye portion 34. Which one of the pair of eye portions 34 is straddled by the loop portion 22 of the slidebolt 16 depends upon whether the slidebolt latching mechanism 12 is mounted on the right or left side of the door 26.

The padlock 14 has a U-shaped shackle 38 and a case 40 mounting the shackle 38. When the one eye portion 34 of the attachment plate 18 projects outwardly through the loop portion 22 of the slidebolt 16 with the slidebolt 16 at the latched position, the unlocked shackle 38 of the padlock 14 can be inserted through an aperture 42 in the one eye portion 34 of the slidebolt latch 12 and then locked to the case 40 so as to retain the slidebolt 16 at the latched position with the eye portion 34 of the attachment plate 18 straddled by the loop portion 22 of the slidebolt 16.

Referring particularly to FIGS. 1-5, there is illustrated the shield device 10A constituting the first version of the first embodiment of the present invention. The shield device 10A basically includes a front cover 44 mounted to the slidebolt latch 12 for movement between covered and uncovered positions. In the covered position shown in FIGS. 1 and 3 and in solid line form in FIG. 2, the front cover 44 overlies and shields the shackle 38 of the padlock 14 coupled to the loop portion 22 of the slidebolt 16, preventing access to the shackle 38 by a cutting tool. However, the bottom of the padlock 14 is exposed for access by a key (not shown) to unlock the shackle 38 from the case 40 of the padlock 14 in order to remove the padlock 14 from the one eye portion 34 on the attachment plate 18 of the slidebolt latch 12. Once the padlock 14 has been removed, the shield device 10A can be easily pivotally moved from the covered to uncovered position away from the loop portion 22 of the slidebolt 16 so as to permit the slidebolt 16 to be slidably moved from the latched position shown in FIGS. 1-3 toward the right to an unlatched position relative to the door jamb eye member 28.

The shield device 10A also includes an attachment means 46 connected to the front cover 44 and disposed at a rear side thereof adjacent to the padlock shackle 38 and the one eye portion 34 of the slidebolt attachment plate 18 for attaching the front cover 44 to the slidebolt latch 12 once the padlock shackle 38 has been coupled to the one eye portion 34 of slidebolt latch 12. The attachment means 46 prevents movement of the front cover 44 relative to the slidebolt latch 12 from the covered to uncovered position and thereby the exposure of the shackle 38 of the padlock 14 to access by a cutting tool.

Figure 2:
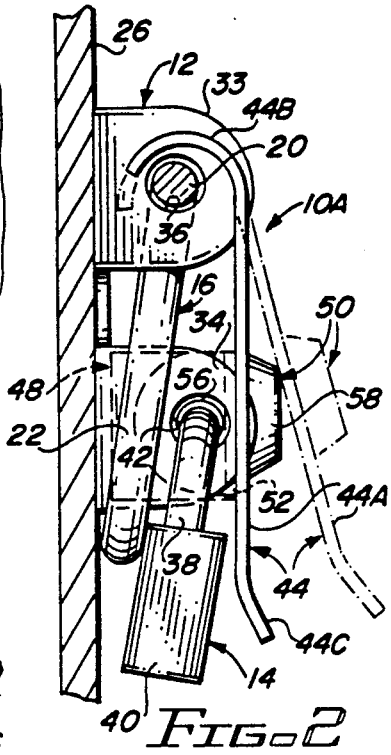
FIG. 2 is an enlarged end elevational view of the shield device as seen along line 2—2 of FIG. 1.
Figure 3:
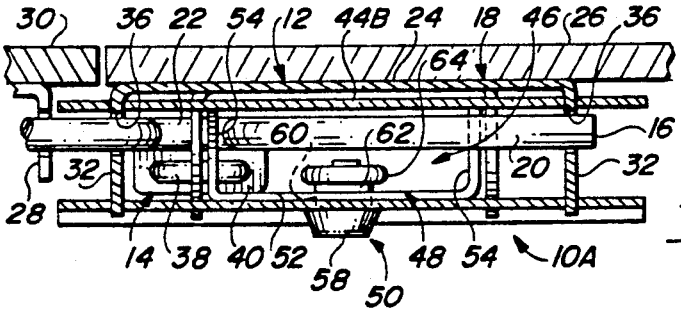
FIG. 3 is an enlarged top view, partly in section, of the shield device taken along line 3—3 of FIG. 1.
Figure 4:
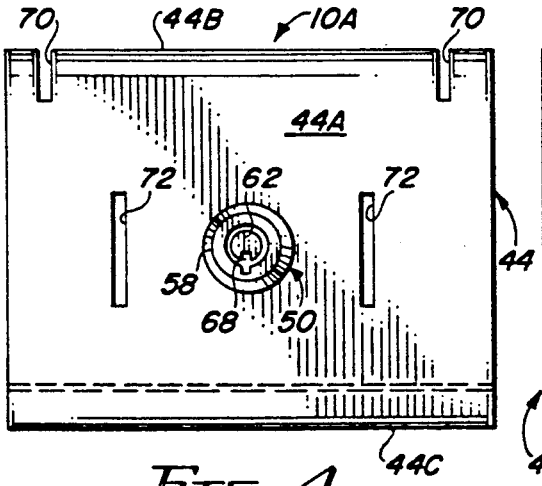
FIG. 4 is a front elevational view of a front cover of the shield device of FIG. 1 removed from the slidebolt latch.
Figure 5:
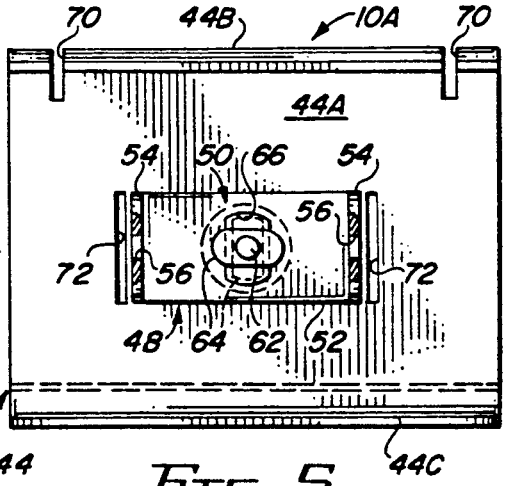
FIG. 5 is a rear elevational view of the front cover of the shield device of FIG. 4, showing also a rear base of the shield device.

More particularly, the front cover 44 is in the form of a substantially flat plate 44A having an arcuate upper edge portion 44B adapted to removably and pivotally hook and mount over the shaft portion 20 of the slidebolt 16 and an outwardly bent lower edge portion 44C. The attachment means 46 includes a rear base 48 and a connection means 50 for connecting the front cover 44 to the rear base 48. The rear base 48 is in the form of a flat plate member 52 and a pair of end members 54 rigidly and integrally attached to the plate member 52 and extending transversely therefrom. As seen in FIGS. 2 and 5, the end members 54 have apertures 56 for receiving the shackle 38 of the padlock 14.

In the shield device 10A constituting the first version of the first embodiment of the present invention, the connection means 50 is in the form of a lock mechanism 50 mounted on the front cover 44 which is operable to permit connecting the front cover 44 to and disconnecting it from the rear base 48. The lock mechanism 50 includes a cylindrical housing 58 stationary attached to the front cover 44 and extending through a central opening 60 in the flat plate 44A of the front cover 44 to the rear side thereof. The lock mechanism 50 also has a rotary cylinder 62 rotatably supported through a central bore in the cylindrical housing 58 and having a transversely extending latch element 64 attached on a rear end thereof. The latch element 64 has a configuration which matches that of a central slot 66 defined in the flat plate member 52 of the rear base 48.

By inserting an appropriate key (not shown) into a keyhole 68 on the front of the cylindrical housing 58, the rotary cylinder 62 can be rotated and the latch element 64 turned between a locked condition and an unlock condition. In the locked condition of the lock mechanism 50 shown in solid line form in FIGS. 3 and 5, the latch element 64 is positioned rearwardly of the flat plate member 52 of the rear base 48 and out of registry with the central slot 66 therein so as to overlap with the opposite edges of the slot 66, thereby attaching the front cover 44 to the rear base 48 so as to retain the front cover 44 at the covered position. In the unlocked condition of the lock mechanism 50 shown in dashed line form in FIG. 5, the latch element 64 is positioned in registry with the central slot 66, thereby detaching the front cover 44 from the rear base 48 so as to permit the front cover 44 to move to the uncovered position. In the uncovered position, which the front cover 44 in dashed line form is shown pivotally moving toward in FIG. 2, the front cover 44 is displaced outwardly from the rear base 48 and from the loop portion 22 of the slidebolt 16.

At such displaced location, the front cover 44 unshields or uncovers the shackle 38 of the padlock 14, being still coupled through one of the apertures 56 of the rear base 48 and the one eye portion 34 of the slidebolt latch attachment plate 18, thereby exposing the shackle 38 to access for removal by a cutting tool. In such manner, the lock mechanism 50 of the shield device 10A allows a self-storage facility manager to unlock and release the front cover 44 from the rear base 48 in order to gain access to a tenant's padlock for removing it in cases where the tenant has vacated or has been evicted for non-payment of rent.

The front cover 44 of the shield device 10A also includes a pair of spaced cutouts 70 defined through the upper edge portion 44B and a pair of spaced slots 72 defined through the flat plate 44A for receiving the spaced mounting ear portions 32 and spaced eye portions 34 projecting from the attachment plate 18 of the slidebolt latch 12. The other of the eye portions 34 and the other of the end members 54 of the rear base 48 can be employed by the facility manager to apply another padlock (not shown) in order to overlock the slidebolt 16 and thereby prevent movement of the slidebolt 18 by a delinquent tenant.

Referring now to FIGS. 6–9, there is illustrated the shield device 10B constituting the second version of the first embodiment of the present invention. The shield device 10B basically also includes a front cover 74 and an attachment means 76. The attachment means 76 includes a rear base 78 and a connection means 80 for connecting the front cover 74 to the rear base 78. The front cover 74 and rear base 78 are substantially flat plates which extend at an acute angle, preferably of less than thirty degrees, relative to one another. Also, the front cover 74 and rear base 78 have respective arcuate upper edge portions 74A, 78A. The arcuate upper edge portion 74A of the front cover 74 overlies and rigidly attaches to the arcuate upper edge portion 78A of the rear base 78. The attached arcuate upper edge portions 74A, 78A of the front cover 74 and rear base 78 are adapted to removably and pivotally hook and mount over the shaft portion 20 of the slidebolt 16. The rear base 78 also has a pair of spaced slots 82 defined therein. One or the other of the slots 82 can receive one of the eye portions 34 of the slidebolt latch 18 therethrough. The shackle 38 of the padlock 14 is coupled through the one eye portion 34 of the slidebolt latch 18 projecting through the slot 82 of the rear base 76 in order to attach the shield device 10B to the slidebolt latch 12. The connection means 80 is a cross brace member 80 extending between and rigidly attached to the front cover 74 and rear base 78.

Figure 7:
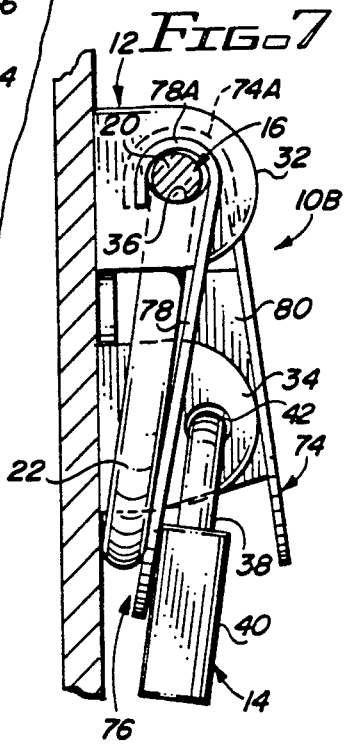
FIG. 7 is an end elevational view of the shield device as seen along line 7—7 of FIG. 6.
Figure 8:
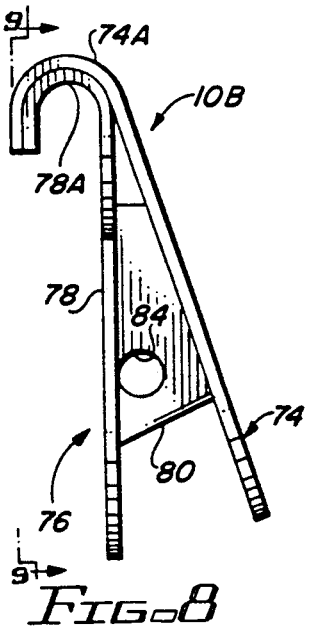
FIG. 8 is an end elevational view of the shield device of FIG. 6 removed from the slidebolt latch.
Figure 9:
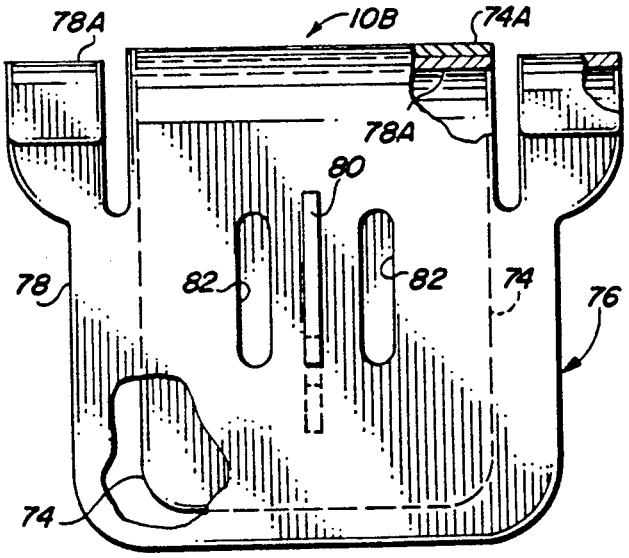
FIG. 9 is a rear elevational view, with portions broken away and sectioned, of the shield device of FIG. 8.
Figure 10:
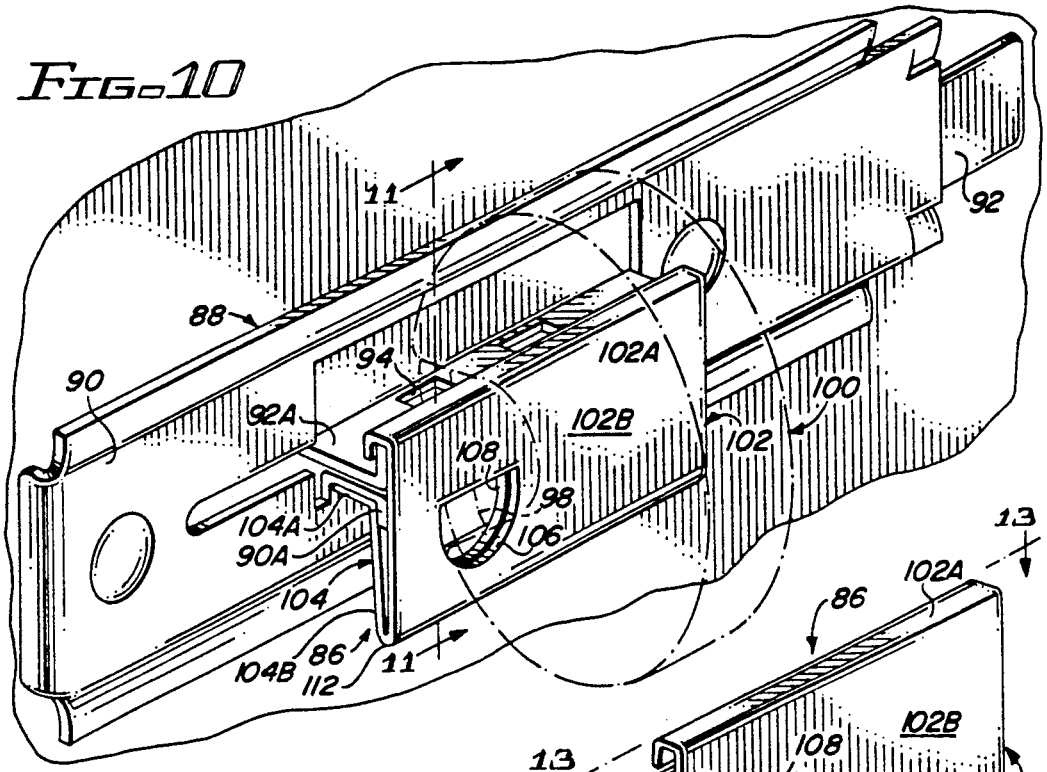
FIG. 10 is a perspective view of a second embodiment of the shield device of the present invention being mounted on a different type of slidebolt latch with a padlock.
Figure 11:
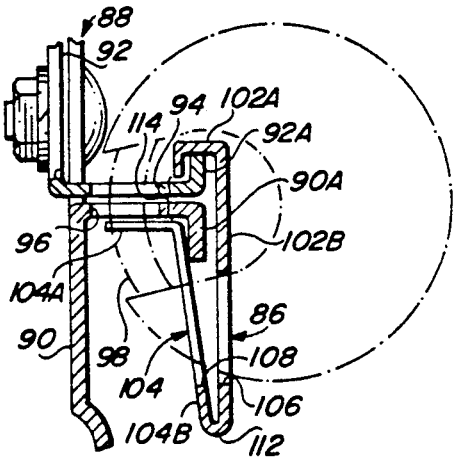
FIG. 11 is an enlarged end sectional view of the shield device as seen along line 11—11 of FIG. 10.
Figure 12:
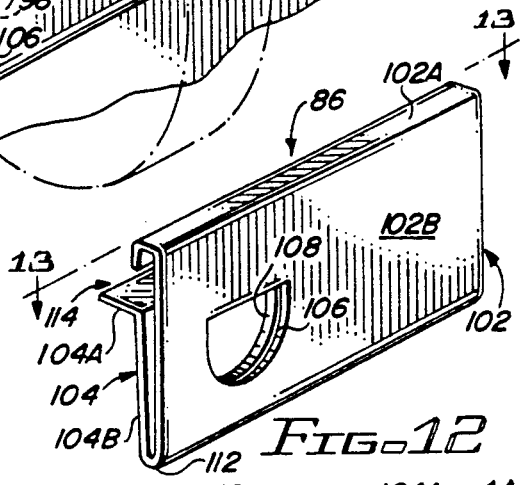
FIG. 12 is a perspective view of the second embodiment of the shield device of FIG. 10 removed from the slidebolt latch.
Figure 13:
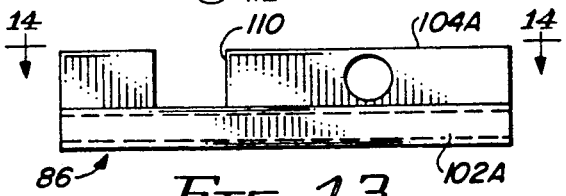
FIG. 13 is a top plan view of the shield device as seen along line 13—13 of FIG. 12.
Figure 14:
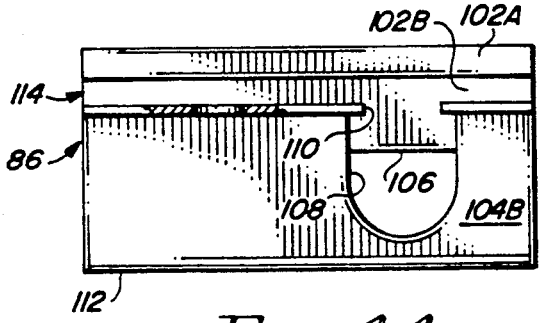
FIG. 14 is a rear elevational view, partly in section, of the shield device as seen along line 14—14 of FIG. 13.

In such manner, the front cover 74 and rear base 78 are mounted to the slidebolt latch 12 for movement between a covered position shown in FIGS. 6 and 7 in which the front cover 74 overlies and shields the shackle 38 of the padlock 14 coupled to the one eye portion 34 of the slidebolt latch 12 and an uncovered position (not shown) in which the front cover 74 and rear base 78 are pivoted outwardly or removed from the slidebolt latch 12. The rigid connection between the front cover 74 and rear base 78 prevents movement of the front cover 74 relative to the slidebolt latch 12 from the covered to uncovered position until the padlock 14 is unlocked and removed from the slidebolt latch 12. The cross brace member 80 also has a hole 84 defined through it which receives the shackle 38 of the padlock 14.

It should be readily apparent that either of the shield devices 10A, 10B of the first and second versions of the first embodiment of the present invention can be provided as components separate from the slidebolt latch 12. Alternatively, the shield devices 10A, 10B can be build into the slidebolt latch 12 in some suitable manner, such as by being permanently pivotally and slidably coupled to the slidebolt 16 thereof.

Referring to FIGS. 10–14, there is illustrated the second embodiment of the shield device of the present invention, generally designated 86. The shield device 86 is particularly adapted for use with another type of slidebolt latch 88 having a pair of stationary and movable plates 90, 92 with respective latch portions 90A, 92A projecting outwardly and movable relative to one another. The latch portions 90A, 92A extend in generally parallel planes and have openings 94, 96 alignable with one another, when the movable plate 92 is in a latched position relative to the stationary plate 90, to receive a shackle 98 of a padlock 100 therethrough for locking the latch portions 90A, 92A together.

Basically, the shield device 86 includes a front cover 102 having an upper edge portion 102A and a main face portion 102B, a rear base 104 having an upper edge portion 104A and a main face portion 104B, and respective apertures 106, 108 defined in the main face portions 102B, 104B of the front cover 102 and rear base 104. The apertures 106, 108 are aligned with the openings 94, 96 in the stationary and movable latch portions 90A, 92A so as to receive therethrough the shackle 98 of the padlock 100 to thereby couple and lock the shield device 86 to the stationary and movable latch portions 90A, 92A of the slidable latch 88 with the stationary and movable plates 90, 92 at the latched position.

In the locked relationship, the upper edge portions 102A, 104A and main face portions 102B, 104B of the respective front cover and rear base 102, 104 are disposed on opposite sides of the latch portions 90A, 92A of the slidebolt latch 88 so as to shield the latch portions 90A, 92 and the padlock shackle 98 coupled thereto. The upper edge portion 102A of the front cover 102 is disposed in an overlying relation to the movable latch portion 92A. The upper edge portion 104A of the rear base 104 has a notch 110 cut therein which opens into the aperture 108 and is aligned with the apertures 106, 108 in the front cover 102 and rear base 104 and the openings 94, 96 in the stationary and movable latch portions 90A, 92A for receiving therethrough the shackle 98 of the padlock 100 so as to thereby retain the shield device 86 in the shielding relation to the shackle 98 of the padlock 100.

Preferably, the main face portion 104B of the rear base 104 is integrally and rigidly connected to the main face portion 102B of the front cover 102 at respective lower edges thereof at 112. The upper edge portion 104A of the rear base 104 is disposable in an underlying relation to the stationary latch portion 90A of the slidebolt latch such that the upper edge portions 102A, 104A of the front cover 102 and rear base 104 together define a slot 114 being open at opposite ends for receiving therethrough the stationary and movable latch portions 90A, 92A of the slidebolt latch 88 and permitting the slidable installing of the shield device 86 from either end thereof.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A slidebolt and padlock security shield device, comprising:

(a) a front cover mountable to a slidebolt latch for movement between a covered position in which said front cover overlies and shields a shackle of a padlock coupled to a latch portion of the slidebolt latch and an uncovered position in which said front cover is displaced from the latch portion of the slidebolt latch, said front cover having a front portion and an arcuate upper edge portion removably mountable over a shaft portion of the slidebolt latch; and (b) means connected solely to said front portion of said front cover and disposed at a rear side thereof in spaced relation from said arcuate upper edge portion thereof and adjacent to the padlock shackle for attaching said front cover to the slidebolt latch when the padlock shackle is coupled to the slidebolt latch so as to prevent movement of said front cover relative to the slidebolt latch from said covered to uncovered position and thereby exposure of the shackle of the padlock.

2. A slidebolt and padlock security shield device, comprising:

(a) a front cover mountable to a slidebolt latch for movement between a covered position in which said front cover overlies and shields a shackle of a padlock coupled to a latch portion of the slidebolt latch and an uncovered position in which said front cover is displaced from the latch portion of the slidebolt latch; and (b) means connected to said front cover and disposed at a rear side thereof adjacent to the padlock shackle for attaching said front cover to the slidebolt latch when the padlock shackle is coupled to the slidebolt latch so as to prevent movement of said front cover relative to the slidebolt latch from said covered to uncovered position and thereby exposure of the shackle of the padlock, said attaching means including (i) a rear base having means defining at least one aperture for receiving the shackle of the padlock, and (ii) a lock mechanism mounted on said front cover and being operable between a locked condition wherein said lock mechanism is attached to said rear base and retains said front cover at said covered position and an unlocked condition wherein said lock mechanism is detached from said rear base and permits said front cover to move to said uncovered position.

3. A slidebolt and padlock security shield device, comprising:

(a) a front cover mountable to a slidebolt latch for movement between a covered position in which said front cover overlies and shields a shackle of a padlock coupled to a latch portion of the slidebolt latch and an uncovered position in which said front cover is displaced from the latch portion of the slidebolt latch; and (b) means connected to said front cover and disposed at a rear side thereof adjacent to the padlock shackle for attaching said front cover to the slidebolt latch when the padlock shackle is coupled to the slidebolt latch so as to prevent movement of said front cover relative to the slidebolt latch from said covered to uncovered position and thereby exposure of the shackle of the padlock, said attaching means being a rear base having a slot defined therein for receiving the latch portion of the slidebolt latch therethrough.

4. A slidebolt and padlock security shield device, comprising:

(a) a front cover mountable to a slidebolt latch for movement between a covered position in which said front cover overlies and shields a shackle of a padlock coupled to a latch portion of the slidebolt latch and an uncovered position in which said front cover is displaced from the latch portion of the slidebolt latch; and (b) means connected to said front cover and disposed at a rear side thereof adjacent to the padlock shackle for attaching said front cover to the slidebolt latch when the padlock shackle is coupled to the slidebolt latch so as to prevent movement of said front cover relative to the slidebolt latch from said covered to uncovered position and thereby exposure of the shackle of the padlock, said attaching means including a rear base having an arcuate upper edge portion removably mountable over a shaft portion of the slidebolt latch; and (c) said front cover having an arcuate upper edge portion removably mountable over the shaft portion of the slidebolt latch, said upper edge portion of said front cover overlying and rigidly attached to said arcuate upper edge portion of said rear base.

5. A slidebolt and padlock security shield device, comprising:

(a) a front cover mountable to a slidebolt latch for movement between a covered position in which said front cover overlies and shields a shackle of a padlock coupled to a latch portion of the slidebolt latch and an uncovered position in which said front cover is displaced from the latch portion of the slidebolt latch;

(b) a rear base locatable adjacent to the padlock shackle and matable with the latch portion of the slidebolt latch for attaching said rear base to the slidebolt latch when the padlock shackle is coupled to the slidebolt length; and (c) means extending between said front cover and said rear base for connecting said front cover to said rear base so as to prevent movement of said front cover relative to the slidebolt latch away from said rear base and thereby expose the shackle of the padlock, said connecting means being a lock mechanism mounted on said front cover and being operable between a locked condition wherein said lock mechanism is attached to said rear base and retains said front cover at said covered position and an unlocked condition wherein said lock mechanism is detached from said rear base and permits said front cover to move to said uncovered position.

6. The shield device of claim 5 wherein said front cover is a plate member having an arcuate upper edge portion removably mountable over a shaft portion of the slidebolt latch.

7. The shield device of claim 5 wherein said rear base includes a plate member and a pair of end members extending transverse to said plate member, said end members having apertures defined therethrough for receiving the shackle of the padlock.

8. The shield device of claim 5 wherein said connecting means is a cross brace member extending between and rigidly attached to said front cover and said rear base.

9. A slidebolt and padlock security shield device, comprising:

(a) a front cover mountable to a slidebolt latch for movement between a covered position in which said front cover overlies and shields a shackle of a padlock coupled to a latch portion of the slidebolt latch and an uncovered position in which said front cover is displaced from the latch portion of the slidebolt latch;

(b) a rear base locatable adjacent to the padlock shackle and matable with the latch portion of the slidebolt latch for attaching said rear base to the slidebolt latch when the padlock shackle is coupled to the slidebolt latch, said rear base being a plate member having a slot defined therein for receiving the latch portion of the slidebolt latch therethrough; and (c) means extending between said front cover and said rear base for connecting said front cover to said rear base so as to prevent movement of said front cover relative to the slidebolt latch away from said rear base and thereby expose the shackle of the padlock.

10. A slidebolt and padlock security shield device, comprising:

(a) a front cover mountable to a slidebolt latch for movement between a covered position in which said front cover overlies and shields a shackle of a padlock coupled to a latch portion of the slidebolt latch and an uncovered position in which said front cover is displaced from the latch portion of the slidebolt latch;

(b) a rear base locatable adjacent to the padlock shackle and matable with the latch portion of the slidebolt latch for attaching said rear base to the slidebolt latch when the padlock shackle is coupled to the slidebolt latch, said rear base having an arcuate upper edge portion removably mountable over a shaft portion of the slidebolt latch; and (c) means extending between said front cover and said rear base for connecting said front cover to said rear base so as to prevent movement of said front cover relative to the slidebolt latch away from said rear base and thereby expose the shackle of the padlock;

(d) said front cover having an arcuate upper edge portion removably mountable over the shaft portion of the slidebolt latch, said upper edge portion of said front cover overlying and rigidly attached to said arcuate upper edge portion of said rear base.

11. The shield device of claim 10 wherein said front cover and said rear base are substantially flat plates extending at an angle of less than thirty degrees relative to one another.

12. In combination with a slidebolt latch having a latch portion for coupling with a padlock in a latched position of said slidebolt latch, a slidebolt and padlock security shield device, comprising:

(a) a front cover mounted on said slidebolt latch for pivotal movement relative thereto and for overlying and shielding a shackle of a padlock coupled to said latch portion of said slidebolt latch;

(b) a rear base located adjacent to the padlock shackle and mated with said latch portion of the slidebolt latch coupled with the shackle of the padlock for attaching said rear base to said slidebolt latch, said rear base being a plate member having a slot defined therein for receiving said latch portion of said slidebolt latch therethrough; and (c) means extending between said front cover and said rear base for connecting said front cover to said rear base so as to prevent movement of said front cover relative to said slidebolt latch away from said rear base and thereby expose the shackle of the padlock.

13. The combination of claim 12 wherein said slidebolt latch includes:

a bracket having an attachment portion mountable to a structure, spaced apart support portions attached to said attachment portion and projecting outwardly therefrom, and said latch portion spaced from said support portions and attached to said attachment portion and projecting outwardly therefrom, said latch portion being capable of receiving the shackle of the padlock; and a slidebolt having a shaft portion mounted to said support portions of said bracket for slidable movement therealong and pivotal movement relative thereto between said latched position and an unlatched position, said slidebolt having a loop portion for straddling said latch portion of said bracket when said slidebolt is at said latched position such that the padlock shackle when received on said latch portion of said bracket retains said loop portion straddling said latch portion and said slidebolt at said latched position.

14. The combination of claim 13 wherein said front cover has an arcuate upper edge portion pivotally mounted over said shaft portion of the slidebolt.

15. The combination of claim 13 wherein said rear base includes a plate member and a pair of end members extending transverse to said plate member, said end members having apertures defined therethrough for receiving the shackle of the padlock.

16. The combination of claim 13 wherein said rear base has an arcuate upper edge portion mounted over said shaft portion of said slidebolt latch.

17. The combination of claim 16 wherein said front cover has an arcuate upper edge portion mounted over said shaft portion of the slidebolt latch, said upper edge portion of said front cover overlying and rigidly attached to said arcuate upper edge portion of said rear base.

18. The combination of claim 17 wherein said front cover and said rear base are substantially flat face plates extending at an angle of less than thirty degrees relative to one another.

19. The combination of claim 13 wherein said connecting means is a cross member extending between and rigidly attached to said front cover and said rear base.

20. A slidebolt and padlock security shield device for use with a slidebolt latch having a pair of stationary and movable latch portions with openings alignable with one another to receive a shackle of a padlock for locking the latch portions together, said security shield device comprising:

(a) a front cover having an upper edge portion and a main face portion;

(b) a rear base having an upper edge portion and a main face portion; and (c) means for defining apertures in said front cover and rear base for alignment with openings in stationary and movable latch portions of a slidebolt latch to receive therethrough a shackle of a padlock to couple said front cover and rear base with the stationary and movable latch portions and thereby attach said security device to the slidebolt latch with said upper edge portions and main face portions of said respective front cover and rear base disposed on opposite sides of the latch portions of the slidebolt latch and shielding the latch portions and padlock shackle coupled thereto.

21. The shield device of claim 20 wherein said upper edge portion of said front cover is disposable in an overlying relation to one of the stationary and movable latch portions of the slidebolt latch such that said main face portion of said front cover substantially shields the latch portions of the slidebolt latch and the shackle of the padlock coupled thereto.

22. The shield device of claim 21 wherein said main face portions are rigidly connected together.

23. The shield device of claim 22 wherein said upper edge portion of said rear base is disposable in an underlying relation to the other of the stationary and movable latch portions of the slidebolt latch such that said upper edge portions of said front cover and rear base together define a slot open at opposite ends for receiving therethrough the stationary and movable latch portions of the slidebolt latch.

24. The shield device of claim 23 wherein said upper edge portion of said rear base has a notch aligned with said apertures and the openings for receiving the shackle of the padlock.

* * * * *